US007475625B1

(12) United States Patent
Niemeyer et al.

(10) Patent No.: US 7,475,625 B1
(45) Date of Patent: Jan. 13, 2009

(54) AMMUNITION, ESPECIALLY PROGRAMMABLE LARGE-CALIBER AMMUNITION

(75) Inventors: Torsten Niemeyer, Celle (DE); Joachim Kuhnle, Hermannsburg (DE); Rainer Himmert, Lauf a. d. Pregnitz (DE); Wolfgang Mosig, Hartmannshof (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 79 days.

(21) Appl. No.: 11/366,240

(22) Filed: Mar. 2, 2006

(30) Foreign Application Priority Data

Mar. 2, 2005 (DE) ..... 10 2005 010 125

(51) Int. Cl.
*F42C 17/04* (2006.01)

(52) U.S. Cl. ..... 89/6; 89/6.5; 89/1.14

(58) Field of Classification Search ..... 89/6, 89/6.5, 1.14; 102/202.5
See application file for complete search history.

(56) References Cited

U.S. PATENT DOCUMENTS

| | | | | | |
|---|---|---|---|---|---|
| 2,924,147 | A * | 2/1960 | Bohl et al. | 89/1.14 |
| 2,926,565 | A * | 3/1960 | Thorness | 89/1.14 |
| 3,024,531 | A * | 3/1962 | Haskell et al. | 30/272.1 |
| 3,185,090 | A * | 5/1965 | Weber | 89/1.14 |
| 3,763,738 | A * | 10/1973 | Temple | 89/1.14 |
| 3,873,786 | A | 3/1975 | Lagofun et al. | |
| 3,988,989 | A * | 11/1976 | Shea | 102/202.14 |
| 3,991,649 | A * | 11/1976 | Patrichi | 89/1.14 |
| 4,062,112 | A * | 12/1977 | Lake | 30/228 |
| 4,493,240 | A * | 1/1985 | Norton | 89/1.14 |
| 4,495,849 | A * | 1/1985 | Cooke et al. | 89/1.14 |
| 4,799,429 | A | 1/1989 | LaBudde et al. | |
| 5,177,317 | A * | 1/1993 | Walker et al. | 89/1.14 |
| 5,343,795 | A | 9/1994 | Ziemba et al. | 89/6.5 |
| 5,361,676 | A * | 11/1994 | Gibbs | 89/1.14 |
| 6,422,119 | B1 | 7/2002 | Boss | 89/6.5 |
| 7,207,253 | B2 * | 4/2007 | Smolders | 89/1.14 |
| 7,222,561 | B2 * | 5/2007 | Brede et al. | 83/639.4 |
| 7,278,612 | B1 * | 10/2007 | Munder | 244/172.6 |
| 2001/0003946 | A1 * | 6/2001 | Garcia et al. | 89/1.13 |
| 2002/0108525 | A1 | 8/2002 | Heitmann et al. | |
| 2004/0003746 | A1 | 1/2004 | Niemeyer et al. | |

(Continued)

FOREIGN PATENT DOCUMENTS

| | | |
|---|---|---|
| DE | 41 02 287 | 7/1992 |

(Continued)

*Primary Examiner*—Bret Hayes
(74) *Attorney, Agent, or Firm*—Klaus P. Stoffel; Wolff & Sampson PC

(57) ABSTRACT

A separating device is integrated in ammunition, with which a line is separated at the earliest possible time during a firing process. The separating device is composed mainly of a piston, which preferably has a sharp edge, is guided in a rigidly mounted cylinder, and, in the unloaded state, is positioned by a shear flange. The cable is preferably securely supported in a protective tube which is connected with a propellant charge primer, and in which the cable is guided as far as the tip of the propellant charge primer and is then further guided to the rear end of the projectile. In the upper area of the cylinder, the cable is guided through a bore, which preferably lies transversely to the direction of acceleration of the piston, so that when the piston moves forward, the cable is separated by the sharp edge of the piston.

14 Claims, 5 Drawing Sheets

U.S. PATENT DOCUMENTS

| | | | | |
|---|---|---|---|---|
| 2004/0007123 | A1* | 1/2004 | Ritchie et al. | 89/1.14 |
| 2004/0221638 | A1* | 11/2004 | Brede et al. | 72/326 |

FOREIGN PATENT DOCUMENTS

| | | | |
|---|---|---|---|
| DE | 44 38 157 | | 12/1995 |
| DE | 100 52 741 | | 5/2002 |
| WO | EP 0 992 762 | A1 | 4/2000 |
| WO | CH691143 | | 4/2001 |
| WO | CH693248 | | 4/2003 |

* cited by examiner

AMMUNITION, ESPECIALLY PROGRAMMABLE LARGE-CALIBER AMMUNITION

BACKGROUND OF THE INVENTION

Various approaches to data transmission are known for setting the fuse of ammunition or programming ammunition in cannon systems.

CH 691 143 A5 discloses a device for measuring projectile velocity at the muzzle of the barrel of a high-cadence cannon. After the velocity has been measured, the fuse is programmed immediately after the projectile has left the muzzle. For this type of programming, the fuse has a programming coil. CH 693 248 A5 describes a similar device.

In addition, EP 0 992 762 B1 discloses a method and a device for transmitting information to programmable projectiles. Here again, the information is transmitted inductively. With reference to U.S. Pat. No. 5,343,795 A, this document addresses the problem that it is important to be able to reset the fuse even in the loaded state.

Especially in the case of large-caliber ammunition, which is stockpiled for extended periods of time and does not have its own voltage or power supply for integrated electronics, the power and/or data supply for the ammunition is realized by a galvanic connecting line between the system electronics of the weapon and the ammunition electronics. This line is located for this purpose inside the ammunition from the shell base to the electronics in the projectile. To allow the transmission of information, the line must be a continuous and secure connection that can be worked through the shell. This can lead to a problem if, upon firing, parts of the line are ejected rearward from the weapon together with the base of the shell, while other parts of the line must leave the barrel at the muzzle end. This can cause remnants of the line or parts of the line to remain in the barrel, which represents a danger especially with respect to the operation of the weapon, for example, in a tank.

In the past, in addition to cables or lines that were securely connected at one end with the propellant charge primer and at the other end with the projectile, exposed plug connections were also used, at which a disconnection of the line was to occur. There is no guarantee that some of the parts will not remain in the barrel.

SUMMARY OF THE INVENTION

The object of the invention is to provide ammunition that performs a well-defined disconnection of the continuous, plugless line in order to prevent undesired remains of the line from remaining in the barrel.

Pursuant to this object, and others which will become apparent hereafter, once aspect of the present invention resides in ammunition comprised of a projectile, an electronic fuse arranged in the projectile, at least one propellant charge primer integrated in a propulsion system, the propellant charge primer having a line or cable by which electric power and/or data is supplied to the electronic fuse in the projectile, and a separating device operatively mounted on a tip of the propellant charge primer for separating the cable.

The invention is based on the idea of incorporating a separating device, with which the separation of the line can be effected at the earliest possible time. The line would preferably be separated at the propellant charge primer. The early separation of the precisely separated line makes it easier to take the line along in the initial stage. In this way, remnants of the cable or line are carried (driven) out of the barrel.

The separating device is incorporated in the ammunition and in a preferred embodiment consists mainly of a piston, which is guided in a rigidly mounted cylinder and preferably has a sharp edge as the cutting device. In the unloaded state, the piston is positioned by a shear flange. The cable is preferably securely supported in a protective tube, which is connected with the propellant charge primer and in which the cable is guided as far as the tip of the propellant charge primer, on which the separating device is mounted. The cable is then guided further to the rear end of the projectile. In the upper area of the separating device, in this case the cylinder, the cable is guided through a bore, which preferably lies transversely to the direction of acceleration of the cutting device, so that when the cutting device moves forward, the cable is separated by the sharp edge of the piston.

It was found to be advantageous to attach the cable to existing components. Thus, the first length of the cable can be supported on the propellant charge primer, and the remaining length of the cable can be supported on the projectile. Since the exposed piece of cable between the propellant charge primer and the projectile is accelerated forward out of the barrel along with the projectile, the separating device is preferably integrated in the propellant charge primer.

To separate the cable, a piston is provided, which is guided in a cylinder and cannot move in the unpressurized state due to suitable measures, such as a mounted shear flange. The piston is set in motion only when pressure builds up inside the propellant charge primer as a result of ignition when the loaded shell is fired and the powder bed ignites in the further course of the firing process. The cable, which preferably lies transversely to the piston, is sheared off by a separating device, such as a cutting edge on the surface of the piston on the opposite side from the pressure zone. This occurs early in the firing process.

The separation of the cable is thus coupled with the pressure buildup that is necessary for the firing process, which has the additional advantage that the time of the separation is reproducible. The cable separation occurs as soon as the pyrotechnic materials in the propellant charge primer have been ignited. The components of the separating device are preferably enclosed to prevent the formation of remnants of the separating device itself. In addition, it is advantageous that the fuse can be reset right up to the time of firing, since the line is closed until this time.

Another advantage is that simple and inexpensive retrofitting is possible. The previously known design of the propellant charge primer for ignition of the shell needs to be only slightly modified. In the simplest variant, the solution is found in the screw plug of the propellant charge primer. In this way, an effect on the ignition length of the propellant charge primer and on the ignition of the powder bed is ruled out.

Other measures can be employed to modify the additional components without any negative effects on the requirements on the propellant charge primer. For example, the interior of the propellant charge primer can be protected from the penetration of moisture, e.g., by gaskets or packing washers.

The invention is explained in greater detail below with reference to the specific embodiment illustrated in the drawings.

DETAILED DESCRIPTION OF THE INVENTION

Figure 1:
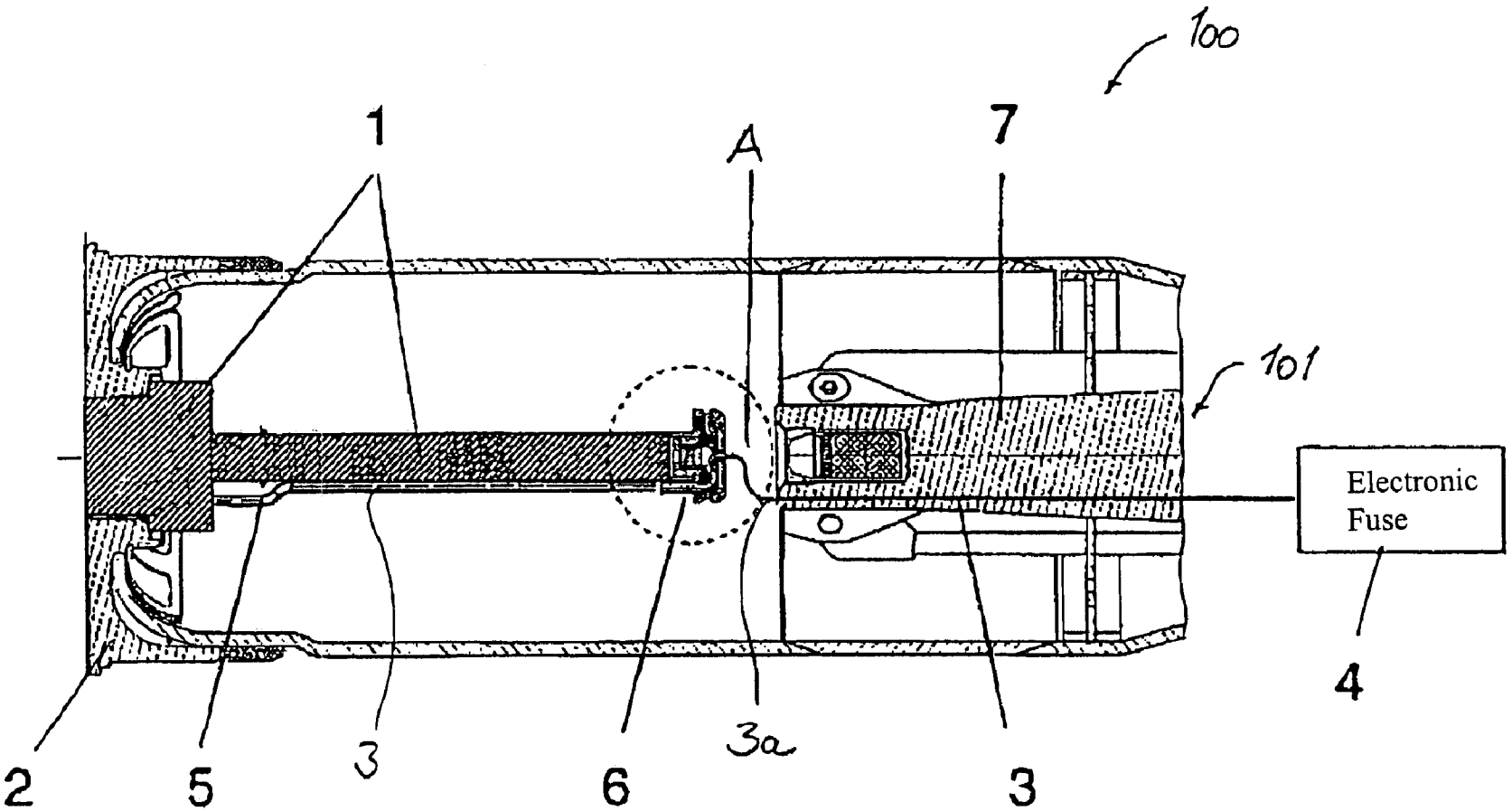
FIG. 1 shows a sectional view of a section of a shell.

FIG. 1 shows a sectional view of, for example, a large-caliber shell 100 with the parts needed to explain the invention. The shell 100 has a propellant charge primer 1, which is integrated in the propulsion mechanism and is part of the shell base 2. The propellant charge primer 1 has a line or a cable 3, by which electric power and/or data is supplied to an electronic fuse 4 in the projectile 101. In a preferred embodiment, the cable 3 is securely supported in a protective tube 5, which is connected with the propellant charge primer 1 and in which the cable 3 is guided as far as the tip 6 of the propellant charge primer 1 and, preferably without further interruption, is guided from the propellant charge primer 1 to the rear end 7 of the projectile, where it can be securely anchored.

Figure 2:
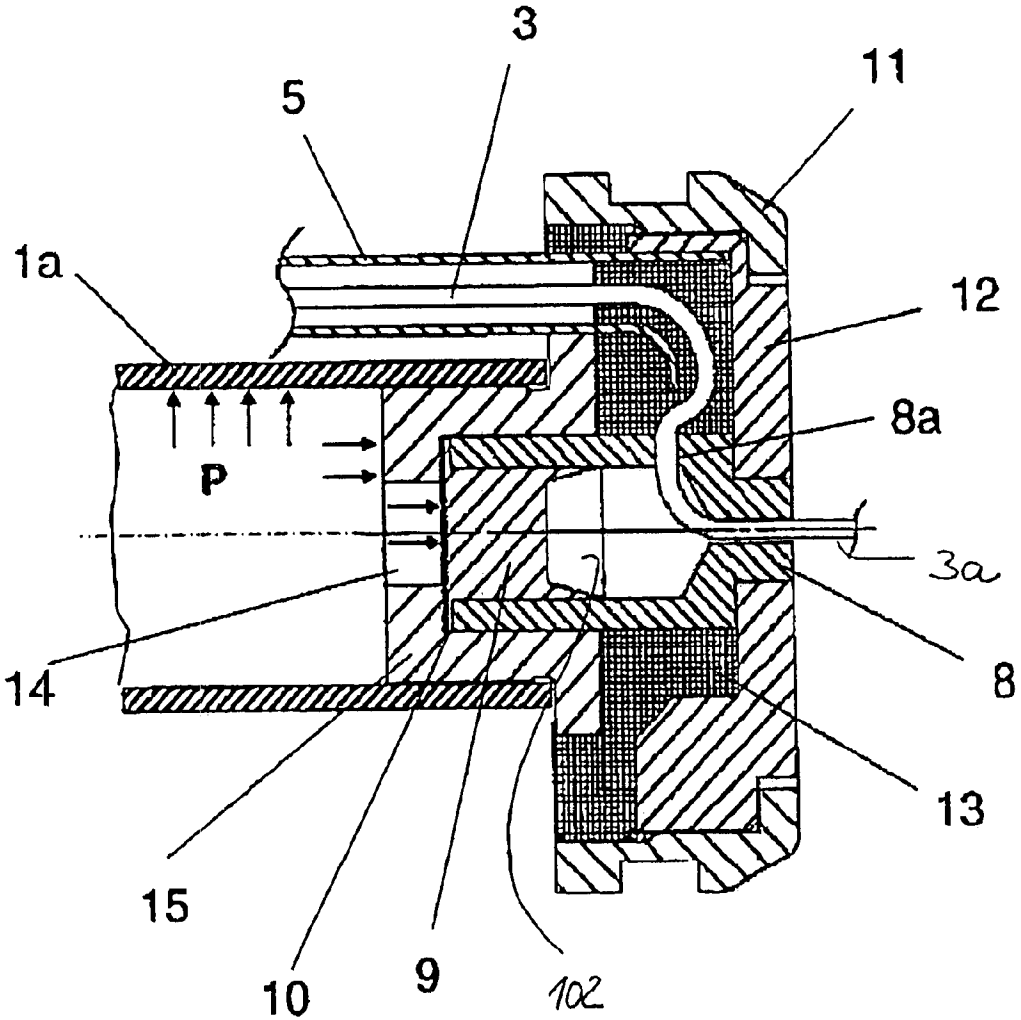
FIG. 2 shows an enlarged view of section A in FIG. 1.

To realize a well-defined separation of the unprotected cable section 3*a*, a separating device 102 is screwed onto the tip 6 of the propellant charge primer 1, preferably on the primer tube 1*a* (FIG. 2). The separating device 102 allows separation of the cable 3 in region 3*a*.

In the simplest embodiment, the separating device 102 can consist mainly of a piston 9, which is guided in a rigidly mounted cylinder 8 and has a sharp edge. In the unloaded state, the piston is positioned by a shear flange 10. In the upper area of the cylinder 8, the cable 3 is guided through a bore 8*a*, which preferably lies transversely to the direction of acceleration of the piston 9, so that when the piston 9 moves forward, the cable is separated by the sharp edge of the piston 9. The acceleration of the piston 9 is effected when the piston 9 is acted upon by the applied internal pressure of the propellant charge primer 1 via a through-bore 14 arranged on the inside, and the strength of the shear flange 10 is exceeded. As soon as the reaction of the powder required for the ignition of the propellant charge occurs inside the propellant charge primer 1, and thus as soon as a pressure buildup P occurs, the surface of the piston 9 is also acted upon. After the shear flange 10 has been sheared off, the internal pressure P drives the piston 9 forward at high speed, and the cutting edge severs the cable 3. After the cable 3 has been severed in this way, the movement of the piston 9 is stopped, for example, by a diameter reduction in the cylinder 8. The conveyance of the cable 3 towards the muzzle of a barrel (not shown) is then taken over by the reacting powder bed. At this time, the cable 3 is no longer securely connected with the propellant charge primer 1.

The cylinder 8 and the piston 9 are preferably integrated in the screw plug 15 of the propellant charge primer 1. The screw plug 15 is mounted on the end face of the propellant charge primer 1. Therefore, in the illustrated embodiment, the piston 9 and cylinder 8 are held in and anchored with the screw plug 15 by parts that are screwed on or inserted, such as screw cap 11 and bushing 12, so that no remnants can arise outside the propellant charge primer 1, by the parts of the separating device 102 itself. The free spaces 13 possibly necessary for working through the cable 3 and the components or parts can be filled in, if necessary, with a liquid, curable compound, e.g., epoxy resin.

Figure 3C:
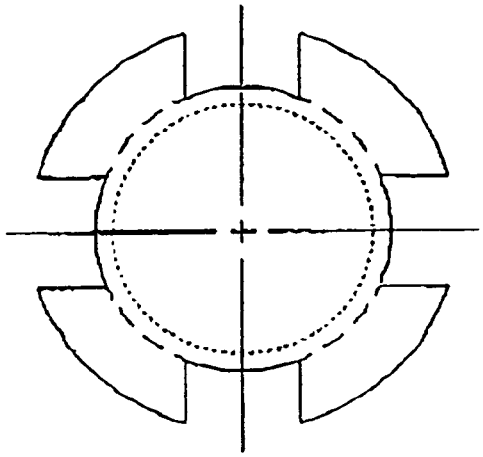
FIG. 3*c* shows another embodiment of the shear flange.
Figure 3B:
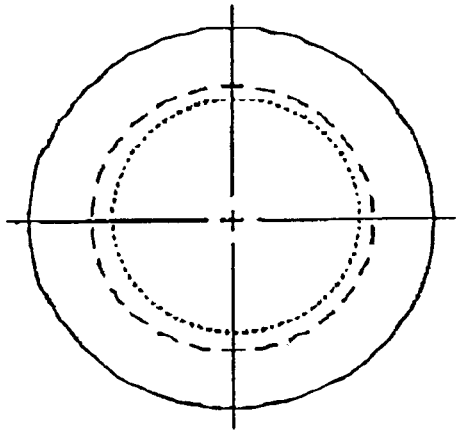
FIG. 3*b* shows one embodiment of the shear figure.
Figure 3A:
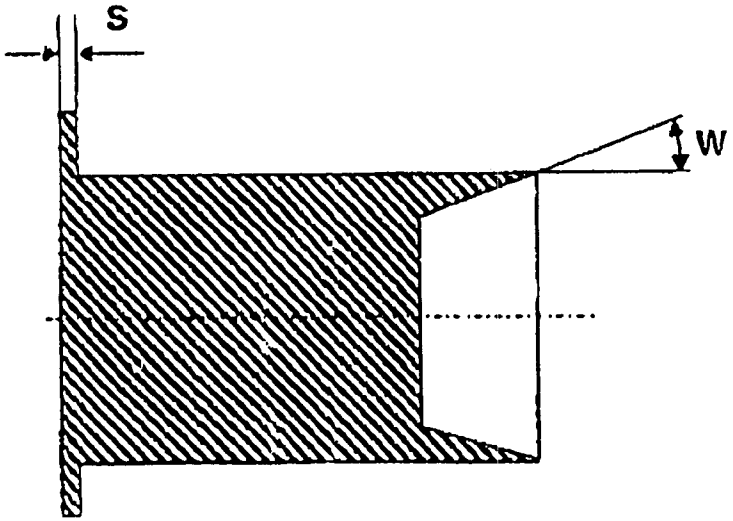
FIG. 3*a* shows a cross-sectional view of a shear flange of the separating device of FIG. 2.

The piston 9 preferably consists of a material that has greater strength than the material of the cable 3. In the embodiment preferred here, the piston 3 consists of a metal. Functional optimization of the piston 3 can be achieved by variation of the thickness "s" of the shear flange, the geometry of the shear flange, and/or the edge geometry. The cutting edge preferably forms a very sharp angle "w" to effect an optimum separation (FIG. 3*a*). The thickness "s" of the shear flange 10 can vary, depending on the level of pressure inside the propellant charge primer 1 (FIG. 3*b*). The shear flange 10 (FIG. 3*b*), which, for example, has a circular shape, can also have a shape of the type shown in FIG. 3*c* by reduction of the shear surfaces.

Figure 4C:
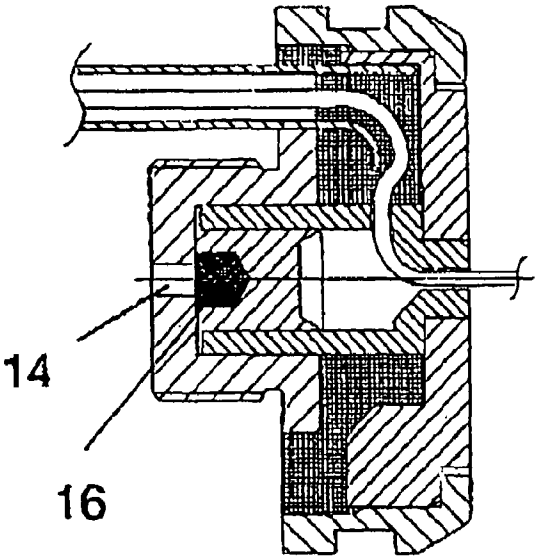
FIGS. 4*a*-4*c* show different bores for optimization inside the separating device of FIG. 2.
Figure 4B:
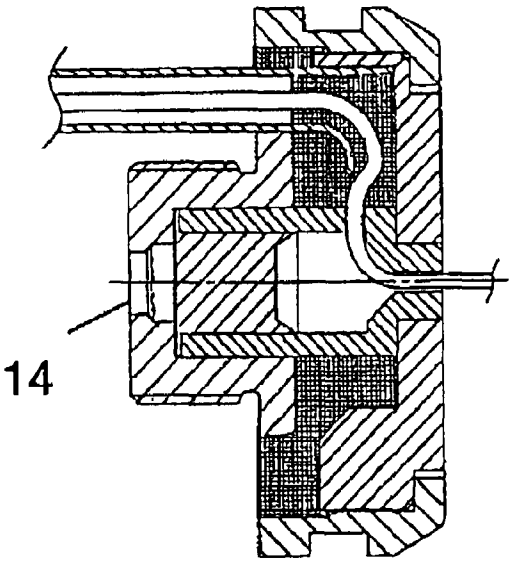
Figure 4A:
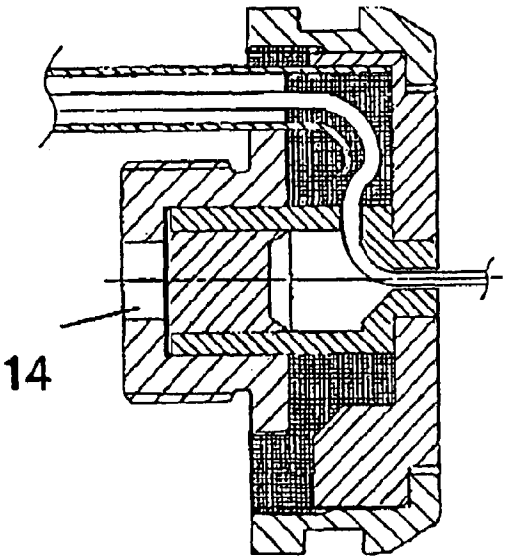

The application of pressure is preferably realized by the bore 14 (FIG. 4) in the screw plug 15. The diameter and the shape of the bore 14*a*,14*b*,14*c* depend on the physical and geometric conditions at the tip 6 of the propellant charge primer 1. To avoid blockage in the bore 14 by parts that get into the bore during the pressure buildup and close the channel, the bore 14*b* can also be designed with several steps. To assist the shearing process, a pyrotechnic secondary charge 16 can be integrated in the piston 9. This secondary charge 16 is ignited by the gases in the propellant charge primer 1 and assists the movement of the piston 9.

Figure 5B:
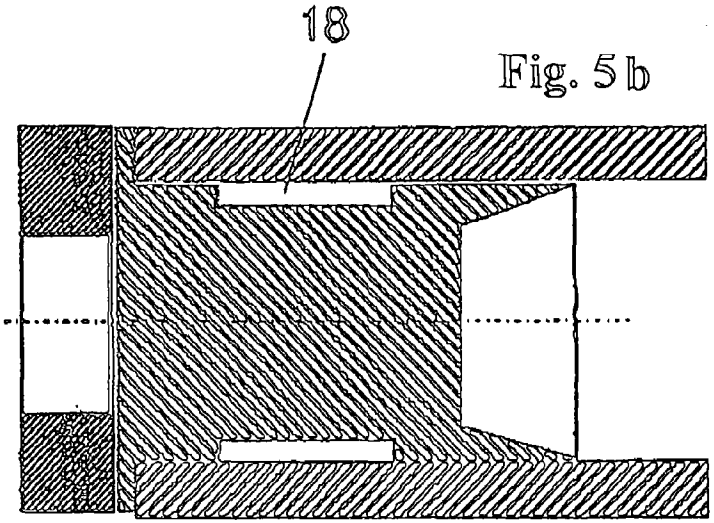
FIGS. 5*a*-5*d* show seals of the propellant charge primer of FIG. 1.
Figure 5D:
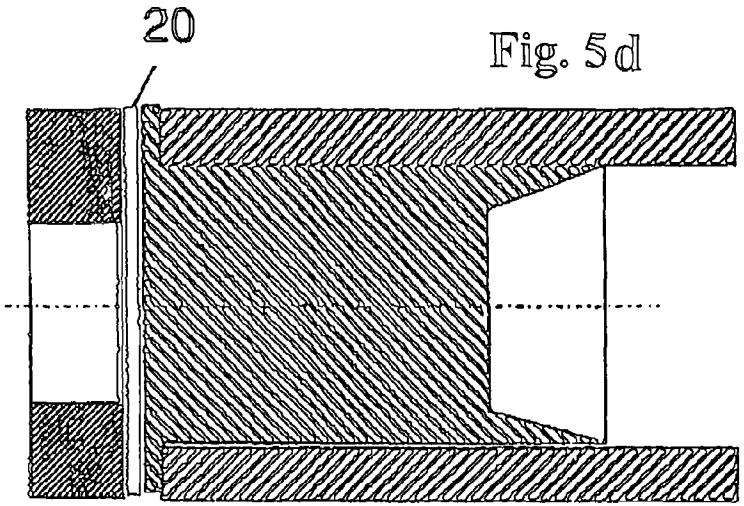
Figure 5A:
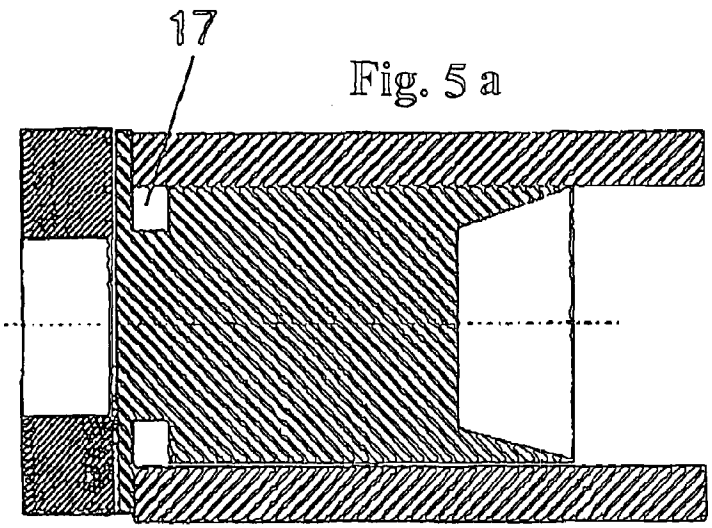
Figure 5C:
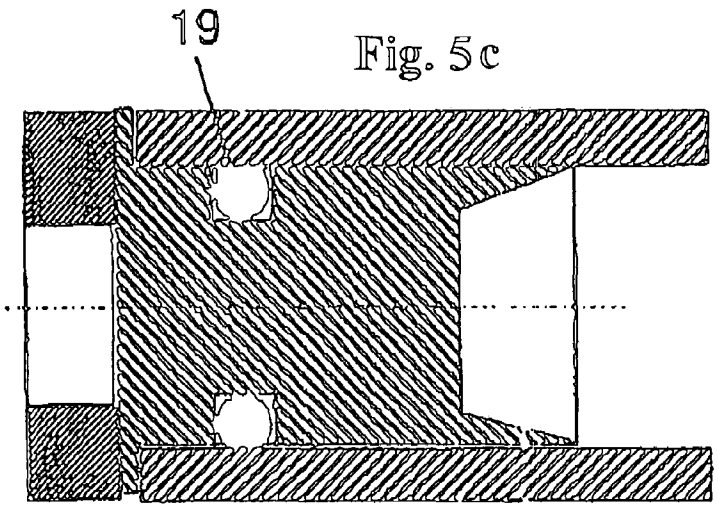

The shearing process of the shear flange 10 can be further supported in a suitable way by providing an undercut 17 between the shear flange 10 and the piston surface (FIG. 5*a*). To support the freedom of movement of the piston 9, the piston 9 can have a peripheral recess 18 (FIG. 5*b*). Sealing elements 19, 20 can be incorporated to seal the interior of the propellant charge primer 1 and/or to protect against moisture. An embodiment illustrated in FIG. 5*c* has an O-ring seal 19 that preferably consists of a soft material integrated in the piston. Another seal embodiment is illustrated in FIG. 5*d*. This seal is produced by a packing washer 20 that acts over the entire inside diameter of the cylinder 8 and is arranged below the piston 9. This seal 20 also preferably consists of a soft material, such as plastic.

Although the present invention has been described in relation to particular embodiments thereof, many other variations and modification and other uses will become apparent to those skilled in the art. It is preferred, therefore, that the present invention be limited not by the specific disclosure herein, but only by the appended claims.

The invention claimed is:

1. Ammunition, comprising: a shell; a projectile; an electronic fuse arranged in the projectile; at least one propellant charge primer integrated in a propulsion system, the propellant charge primer being arranged in the shell and having a line or a cable by which electric power and/or data is supplied to the electronic fuse in the projectile; and a separating device operatively mounted on a tip of the propellant charge primer for separating the line or cable, the separating device including a piston guided in a rigidly mounted cylinder so as to be movable forward toward the projectile.

2. The ammunition in accordance with claim 1, and further comprising a protective tube connected with the propellant charge primer and in which the cable is securely supported and guided as far as the tip of the propellant charge primer, and the cable extending to a rear end of the projectile.

3. The ammunition in accordance with claim 1, wherein the separating device is screwed onto a primer tube.

4. The ammunition in accordance with claim 1, wherein the piston has a sharp edge.

5. The ammunition in accordance with claim 1, and further comprising a shear flange arranged to position the piston in an unloaded state.

6. The ammunition in accordance with claim 4, wherein a bore is provided in an upper area of the cylinder, the cable being guided through the bore so that when the piston moves forward the cable is separated by the sharp edge of the piston.

7. The ammunition in accordance with claim 6, wherein the bore lies transversely to a direction of acceleration of the piston.

8. The ammunition in accordance with claim 5, wherein a through-bore is arranged in the propellant charge primer so that an applied internal pressure of the propellant charge primer acts on the piston through the through-bore when strength of the shear flange is exceeded.

9. The ammunition in accordance with claim 1, wherein the cylinder has a diameter reduction provided so as to stop movement of the piston.

10. The ammunition in accordance with claim 1, wherein the propellant charge primer has a screw plug, the cylinder and the piston being integrated in the screw plug of the propellant charge primer, the screw plug being mounted on an end face of the propellant charge primer.

11. The ammunition in accordance with claim 10, wherein the piston and the cylinder are held in and anchored with the screw plug by parts that are screwed on or inserted.

12. The ammunition in accordance with claim 11, wherein the piston and the cylinder are held in and anchored with the screw plug by a screw cap and a bushing.

13. The ammunition in accordance with claim 1, wherein free spaces present for working through the cable and the separating device are filled in with a liquid, curable compound.

14. The ammunition in accordance with claim 1, and further comprising a sealing element incorporated in or below the piston to seal an interior of the propellant charge primer and/or to protect against moisture.

* * * * *